US009394659B2

(12) United States Patent
Busque

(10) Patent No.: US 9,394,659 B2
(45) Date of Patent: Jul. 19, 2016

(54) SNOW BLOWER WITH A SECURING MECHANISM FOR A ROTATING DRUM

(71) Applicant: RAD Technologie, Thetford Mines (CA)

(72) Inventor: Martin Busque, Beauceville (CA)

(73) Assignee: RAD Technologies Inc, Thetford Mines (CA)

( * ) Notice: Subject to any disclaimer, the term of this patent is extended or adjusted under 35 U.S.C. 154(b) by 10 days.

(21) Appl. No.: 14/602,479

(22) Filed: Jan. 22, 2015

(65) Prior Publication Data

US 2015/0204037 A1 Jul. 23, 2015

Related U.S. Application Data

(60) Provisional application No. 61/930,435, filed on Jan. 22, 2014.

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/04; E01H 5/045; E01H 5/076; E01H 5/098
USPC ..... 37/260, 261, 262
See application file for complete search history.

(56) References Cited

U.S. PATENT DOCUMENTS 421,768 A * 2/1890 Schefflere ..... E01H 1/045 37/209
1,701,767 A * 2/1929 Barry ..... E01H 5/098 37/251
2,583,753 A * 1/1952 Spreng ..... A01M 7/0014 239/176
2,776,505 A * 1/1957 Root ..... E01H 5/076 37/252
2,794,271 A * 6/1957 Wallack ..... E01H 5/098 37/260
2,802,287 A * 8/1957 Bevan ..... E01H 5/076 198/518
3,222,802 A * 12/1965 Kiernan ..... E01H 5/098 37/236
3,461,578 A * 8/1969 Van Der Lely ..... E01H 5/076 37/231
3,696,535 A * 10/1972 Kallio ..... E01H 5/04 198/637
4,312,143 A * 1/1982 Kado ..... E01H 5/045 37/261
4,498,253 A * 2/1985 Schmidt ..... E01H 5/076 37/197
5,444,927 A * 8/1995 Sosenko ..... E01H 5/045 37/244
6,212,799 B1 * 4/2001 Gingerich ..... E01H 5/04 37/246

* cited by examiner

*Primary Examiner* — Jamie L McGowan

(57) ABSTRACT

A snow blower comprises a frame, an auger, a fan, a hydraulic system, a rotating drum, a securing mechanism and a disengagement mechanism. The auger is rotationally mounted to the frame, and is adapted for collecting snow. The fan is mounted upon the frame, behind the auger, and evacuates the collected snow in the rotating drum. The hydraulic system rotates the rotating drum with respect to the frame. The rotating drum defines a pair of teeth about a circumference thereof. The securing mechanism is affixed to the frame, and includes on one extremity a pair of complementary circular cams, and on a second extremity a pressure mechanism for applying pressure on the pair of complementary circular cams to keep the pair of complementary circular cams engaged. Upon pressure applied by the hydraulic system to rotate the rotating drum, the disengagement mechanism cooperates with the pair of teeth to counteract the pressure applied by the pressure mechanism and disengages the disengagement mechanism from the pair of teeth.

6 Claims, 8 Drawing Sheets

DETAIL A

SNOW BLOWER WITH A SECURING MECHANISM FOR A ROTATING DRUM

TECHNICAL FIELD

The present disclosure relates to the field of snow blowers with a rotating drum, and more particularly to a securing mechanism controlling a rotation of the rotating drum.

BACKGROUND

Snow blowers are generally equipped with a drum for collecting and evacuating snow processed by a dedicated part of the snow blower, such as an auger. The drum may have several positions for evacuating the collected snow. For example, a first position for evacuating the collected snow on the right side of the snow blower, a second position for evacuating the collected snow on the left side of the snow blower, and a third position for evacuating the collected snow on the top of the snow blower. The drum can be rotated from one position to another to select the appropriate position of evacuation of the snow. However, when the snow blower is in operation and processing snow, some physical constraints may be applied to the drum, leading to an unwanted rotation of the drum from its current position of evacuation.

There is therefore a need for a securing mechanism for a rotating snow blower drum.

SUMMARY

According to a first aspect, the present disclosure provides a snow blower. The snow blower comprises a frame. The snow blower comprises an auger rotationally mounted to the frame, the auger being adapted for collecting snow upon rotation thereof. The snow blower comprises a fan mounted upon the frame behind the auger, the fan evacuating the collected snow into a rotating drum. The snow blower comprises a hydraulic system for rotating the rotating drum with respect to the frame. The rotating drum defines a pair of teeth about a circumference thereof. The snow blower comprises a securing mechanism affixed to the frame. The securing mechanism includes on one extremity a pair of complementary circular cams. The securing mechanism includes on a second extremity a pressure mechanism for applying pressure on the pair of complementary circular cams to keep the pair of complementary circular cams engaged. The pair of complementary circular cams includes a disengagement mechanism. Upon pressure applied by the hydraulic system to rotate the rotating drum, the disengagement mechanism cooperates with the pair of teeth to counteract the pressure applied by the pressure mechanism to disengage the disengagement mechanism from the pair of teeth.

DETAILED DESCRIPTION

The foregoing and other features will become more apparent upon reading of the following non-restrictive description of illustrative embodiments thereof, given by way of example only with reference to the accompanying drawings. Like numerals represent like features on the various drawings.

Various aspects of the present disclosure generally address one or more of the problems related to the occurrence of an unwanted rotation of a rotating drum of a snow blower.

Figure 1:
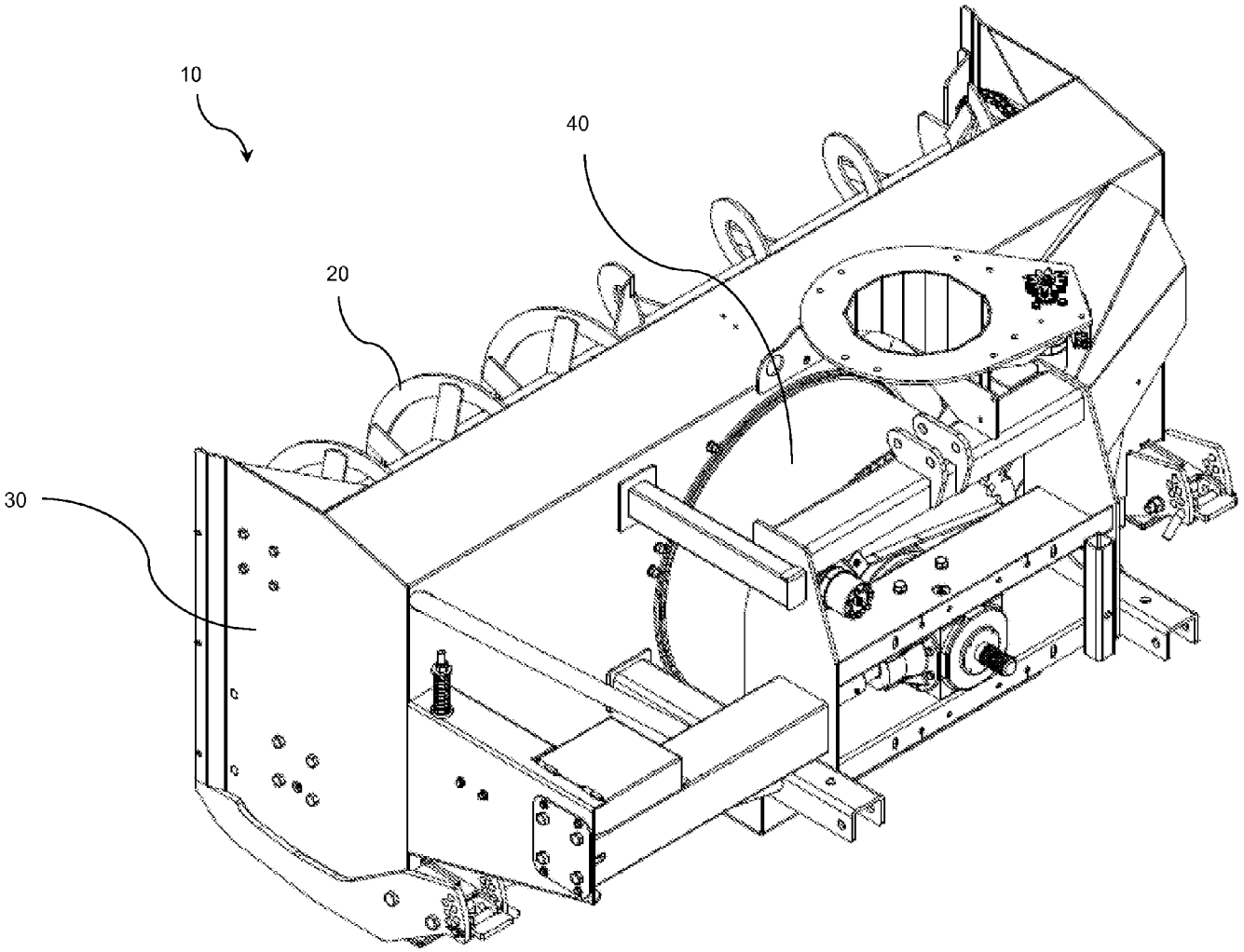
FIG. 1 illustrates a rear perspective view of a snow blower with a rotating drum.
Figure 2:
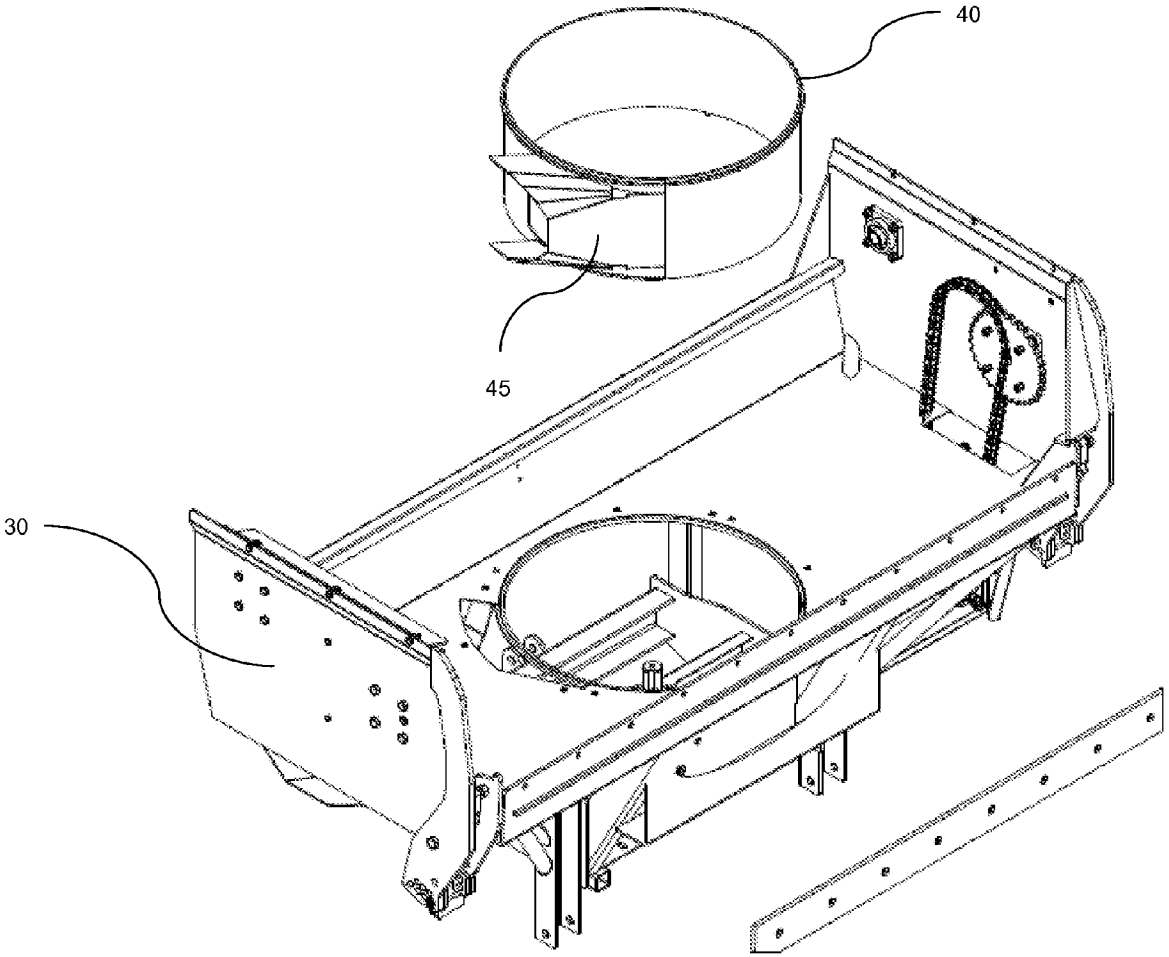
FIG. 2 illustrates a perspective view of the rotating drum and of a frame of the snow blower of FIG. 1.

Reference is now made concurrently to FIGS. 1 and 2, which represent a snow blower 10. The snow blower 10 comprises a frame 30. The snow blower 10 also comprises an auger 20 rotationally mounted to the frame 30. The auger 20 is adapted for collecting snow upon rotation thereof.

The snow blower 10 further comprises a rotating drum 40, and a fan not represented in the Figures for simplification purposes. The fan is mounted upon the frame 30 behind the auger 20 and evacuates the snow collected by the auger 20 into the rotating drum 40. In one particular embodiment, the fan is at least partially located inside the rotating drum 40.

Reference is now made concurrently to FIGS. 3-8, which represent a securing mechanism 100 affixed to the frame 30, for controlling a rotation of the rotating drum 40 of the snow blower 10.

Figure 8:
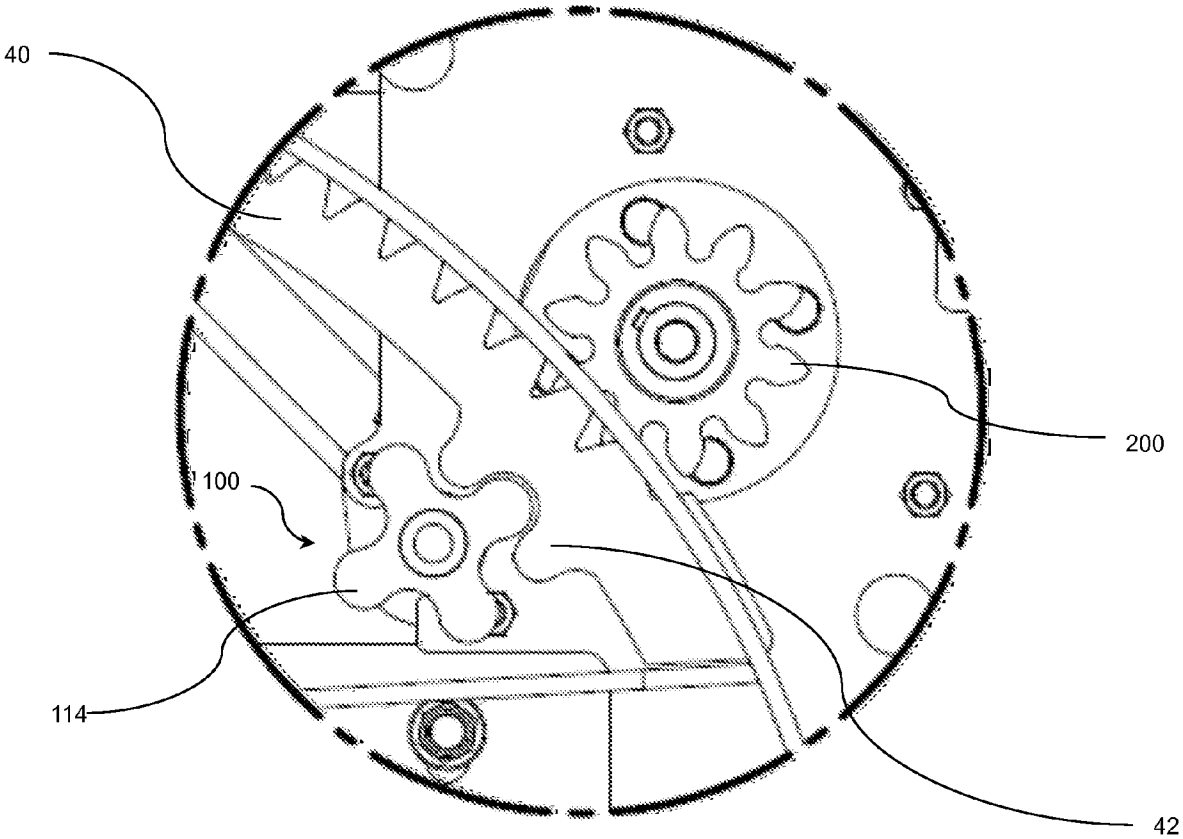

As illustrated in FIG. 8, the snow blower 10 comprises an hydraulic system 200 for rotating the rotating drum 40 with respect to the frame 30. In a particular embodiment, the hydraulic system 200 consists of an hydraulic engine.

Figure 6:
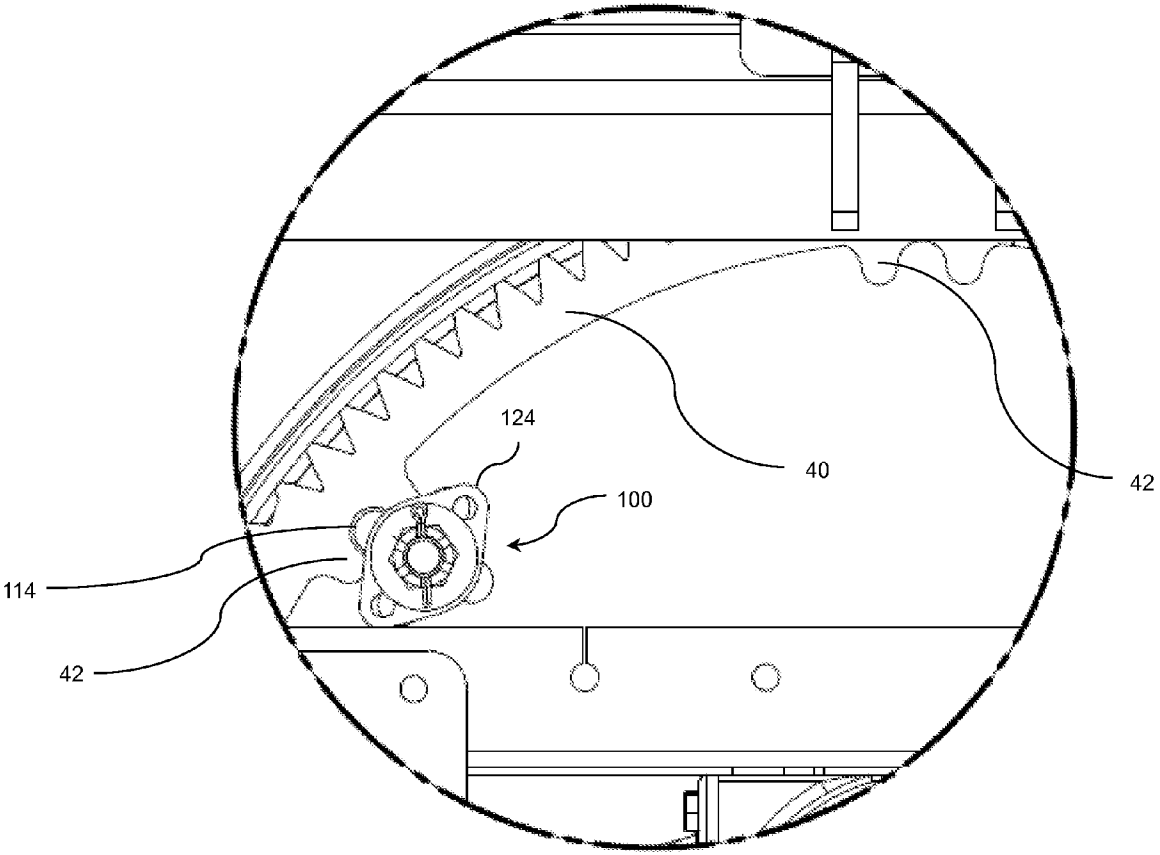
Figure 7:
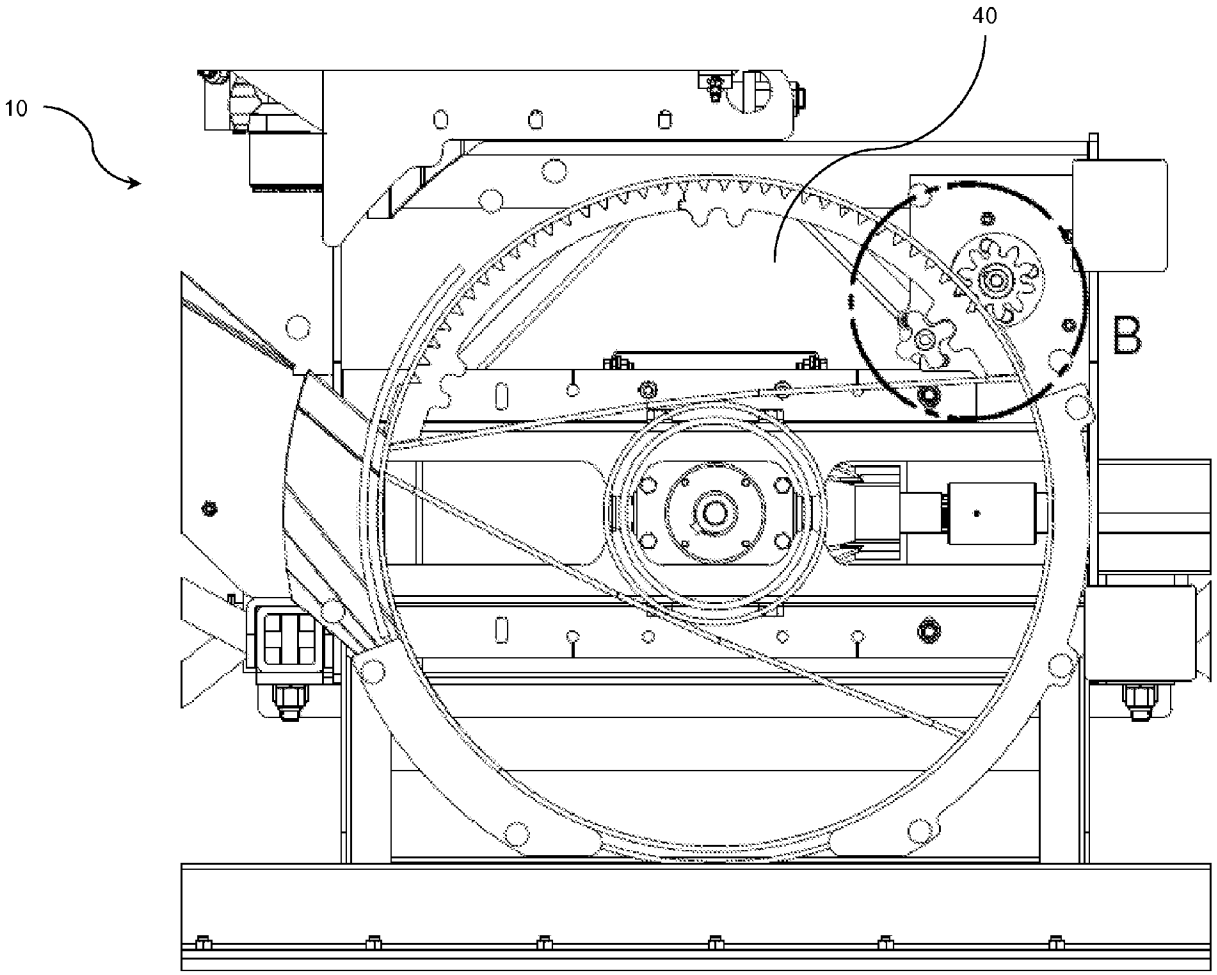
FIGS. 7 and 8 illustrate a front side view of the securing mechanism of FIG. 3 engaged with the rotating drum of FIGS. 1 and 2.

As illustrated in FIGS. 6 and 8, the rotating drum 40 defines a pair of teeth 42 about a circumference thereof. In various embodiments of the rotating drum 40, a specific number of pairs of teeth 42 may be located at various positions about the circumference of the rotating drum 40. For instance, the rotating drum 40 may define three pairs of teeth located at three different positions about the circumference of the rotating drum. Furthermore, the three different positions may allow evacuation of the snow from the rotating drum 40 on the left, on the right and on the top of the snow blower 10.

In the embodiment represented in FIGS. 6 and 8, the pair of teeth 42 is located inside the rotating drum 40. In an alternative embodiment, the pair of teeth 42 may be located outside the rotating drum 40.

Figure 3:
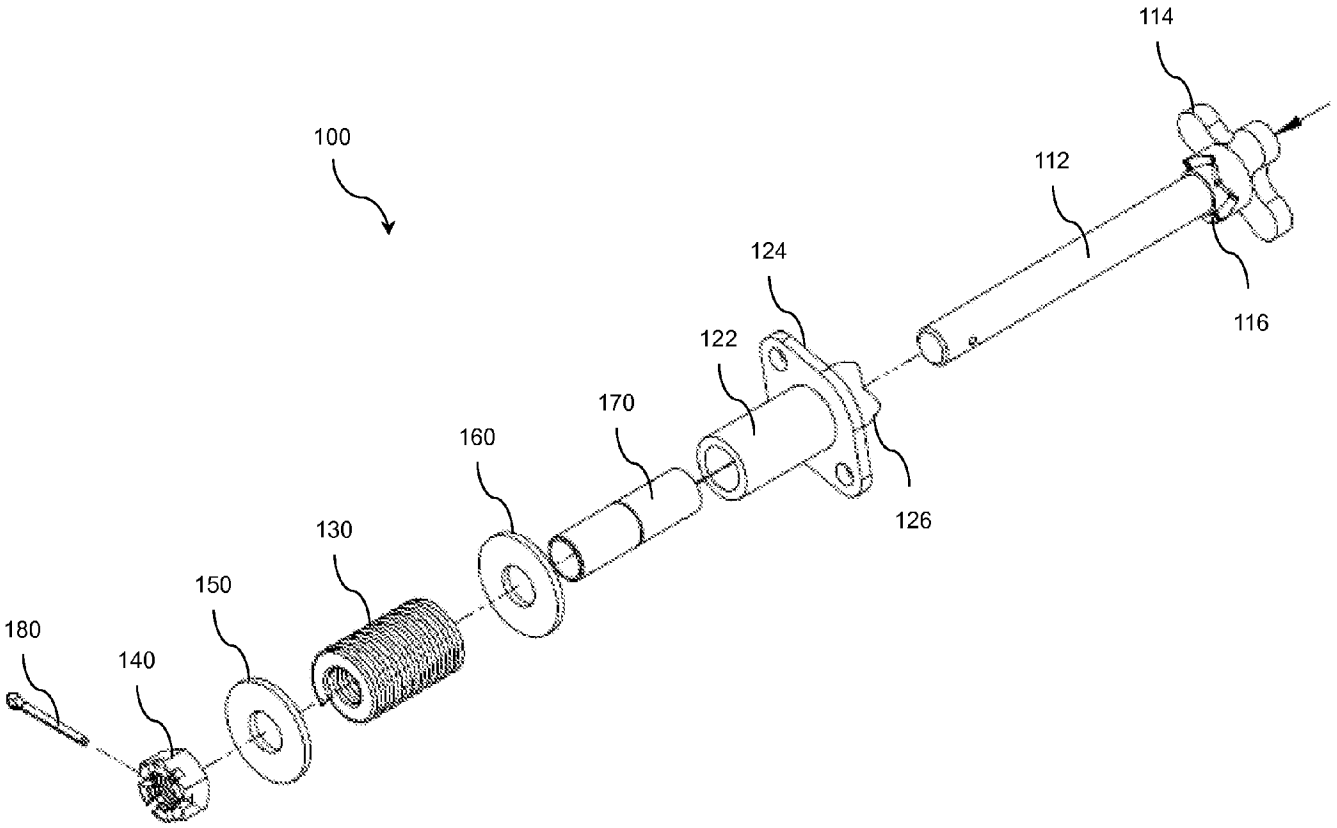
FIG. 3 illustrates an exploded view of a securing mechanism for the rotating drum of FIGS. 1 and 2.
Figure 4:
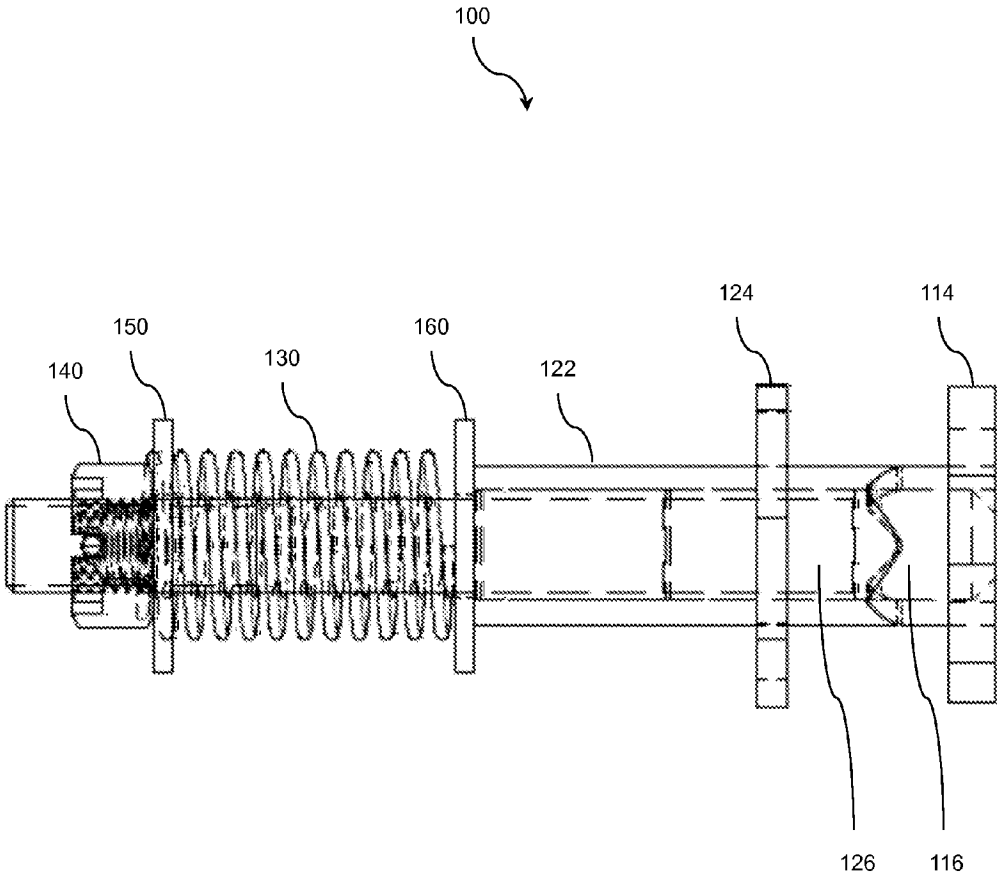
FIG. 4 illustrates a right side view of the securing mechanism of FIG. 3.
Figure 5:
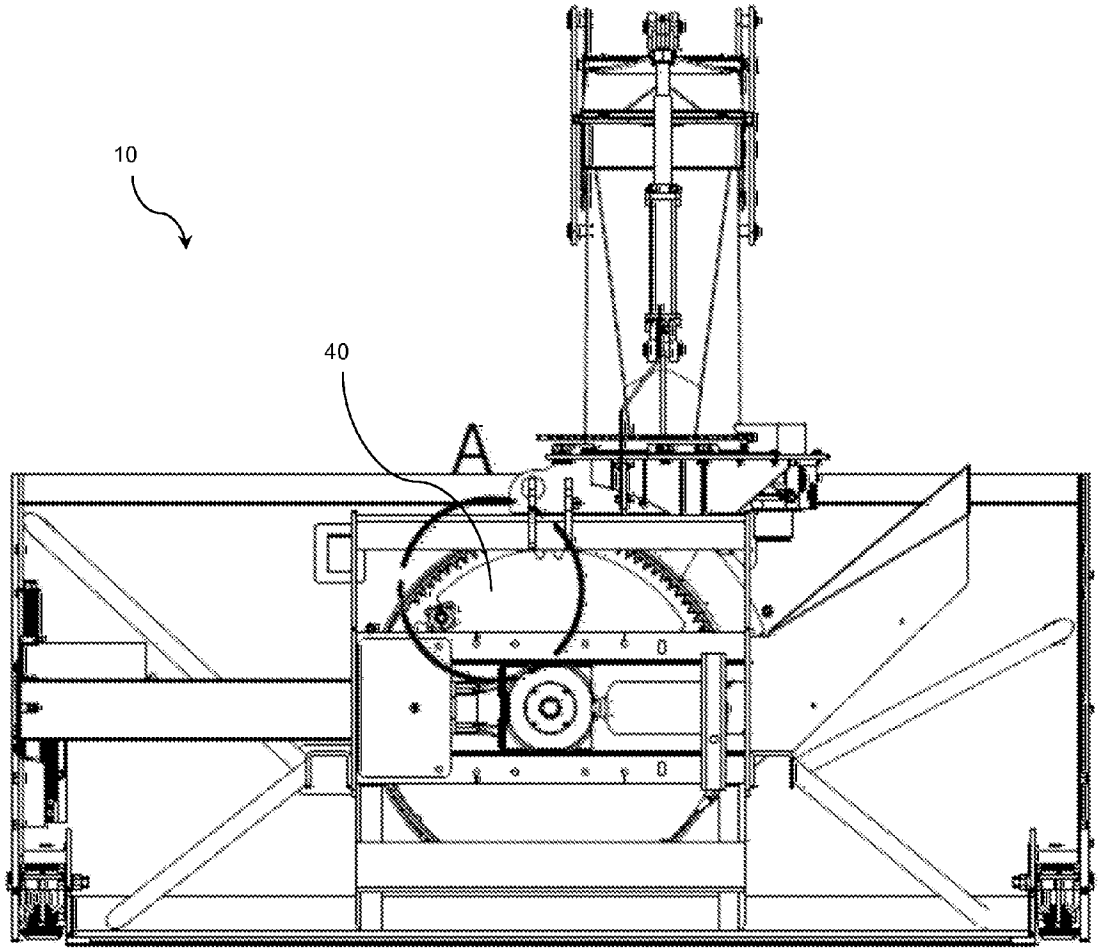
FIGS. 5 and 6 illustrate a rear side view of the securing mechanism of FIG. 3 engaged with the rotating drum of FIGS. 1 and 2.

An exploded view of an illustrative embodiment of the securing mechanism 100 is represented in FIG. 3. The securing mechanism 100 includes on one extremity a pair of complementary circular cams 116 and 126. The securing mechanism includes on a second extremity a pressure mechanism for applying pressure on the pair of complementary circular cams 116 and 126, to keep the pair of complementary circular cams engaged 116 and 126 engage. In one embodiment, the pressure mechanism comprises a spring 130. The spring 130 may be operating with a pressure comprised between 338 and 775 lbs.

The securing mechanism 100 includes an attachment 124, for affixing the security mechanism 100 to the frame (not represented in FIGS. 3-8 for simplification purposes) of the snow blower 10.

The pair of complementary circular cams 116 and 126 include a disengagement mechanism 114. Upon pressure applied by the hydraulic system 200 to rotate the rotating drum 40, the disengagement mechanism 114 cooperates with the pair of teeth 42 to counteract the pressure applied by the pressure mechanism 130 to disengage the disengagement mechanism 114 from the pair of teeth 42.

In an embodiment illustrated in FIG. 3, the circular cam 116 comprises a stem 112. The circular cam 126 comprises an extremity 122 opposite to the circular cam 116 for receiving a first extremity of a threaded sleeve 170. The second extremity of the threaded sleeve 170 is engaged in a first washer 160, in the spring 130, in a second washer 150; and secured to a nut 140. The stem 112 is engaged inside the threaded sleeve 170 and maintained in position by a pin 180.

The complementary circular cams 116 and 126 may be made of steel. In a particular embodiment, the complementary circular cams 116 and 126 have an height of one quarter (¼) of an inch and a length of three sixteen (3/16) of an inch.

Although the present disclosure has been described in the foregoing description by way of illustrative embodiments thereof, these embodiments can be modified at will, within the scope of the appended claims without departing from the spirit and nature of the appended claims.

What is claimed is:

1. A snow blower comprising:

a frame;

an auger rotationally mounted to the frame, the auger being adapted for collecting snow upon rotation thereof;

a fan mounted upon the frame behind the auger, the fan evacuating the collected snow into a rotating drum;

a hydraulic system for rotating the rotating drum with respect to the frame;

the rotating drum defining a pair of teeth about a circumference thereof; and a securing mechanism affixed to the frame, the securing mechanism including on one extremity a pair of complementary circular cams, the securing mechanism including on a second extremity a pressure mechanism for applying pressure on the pair of complementary circular cams to keep the pair of complementary circular cams engaged;

the pair of complementary circular cams including a disengagement mechanism;

upon pressure applied by the hydraulic system to rotate the rotating drum the disengagement mechanism cooperates with the pair of teeth to counteract the pressure applied by the pressure mechanism to disengage the disengagement mechanism from the pair of teeth.

2. The snow blower of claim 1 wherein the pair of teeth is located inside the rotating drum.

3. The snow blower of claim 1 wherein the pressure mechanism comprises a spring.

4. The snow blower of claim 3 wherein the pressure of the spring is comprised between 388 and 775 lbs.

5. The snow blower of claim 1 wherein the rotating drum defines three pairs of teeth located at three different positions about the circumference of the rotating drum.

6. The snow blower of claim 5 wherein the three different positions allow evacuation of the snow from the rotating drum on the left, on the right and on the top of the snow blower.

* * * * *